United States Patent [19]

Bowman

[11] Patent Number: 4,510,469

[45] Date of Patent: Apr. 9, 1985

[54] SELECTIVE WAVEGUIDE MODE CONVERTER

[75] Inventor: David F. Bowman, Moorestown, N.J.

[73] Assignee: RCA Corporation, New York, N.Y.

[21] Appl. No.: 499,395

[22] Filed: May 31, 1983

[51] Int. Cl.[3] ..... H01P 1/16

[52] U.S. Cl. ..... 333/21 R; 343/783; 333/157

[58] Field of Search ..... 333/21 R, 21 A, 137, 333/135, 248, 251, 252; 343/783, 784, 785, 786, 909, 756, 781 R, 753

[56] References Cited

U.S. PATENT DOCUMENTS

| | | | |
|---|---|---|---|
| 2,511,610 | 6/1950 | Wheeler | 333/243 |
| 2,669,657 | 2/1954 | Cutler | 343/783 |
| 2,762,982 | 9/1956 | Morgan, Jr. | 333/243 |
| 3,500,258 | 3/1970 | Nagelberg | 333/21 R |
| 3,521,288 | 7/1970 | Schell | 343/781 R |
| 3,624,655 | 11/1971 | Sato et al. | 343/756 |
| 3,750,182 | 7/1973 | Kernweis | 343/783 |
| 3,831,177 | 8/1974 | Soong | 343/776 |
| 4,141,015 | 2/1979 | Wong et al. | 343/786 |

OTHER PUBLICATIONS

"Dielectric-Loaded Horn Antenna", IEEE Transactions on Antennas and Propagation, Mar. 1972, pp. 199–201, by Toshio Satoh.

*Primary Examiner*—Eugene R. LaRoche
*Assistant Examiner*—Benny T. Lee
*Attorney, Agent, or Firm*—Joseph S. Tripoli; Robert L. Troike; Robert Ochis

[57] ABSTRACT

A mode converter is disclosed which selectively generates a predetermined higher order mode(s) from an incident fundamental mode. This mode converter comprises a dielectric region having an effective-dielectric-constant/thickness profile which is the same as the amplitude profile of the desired higher order mode(s).

8 Claims, 14 Drawing Figures

SELECTIVE WAVEGUIDE MODE CONVERTER

This invention relates to guided electro-magnetic waves and more particularly to mode converters for such guided waves.

My related patent applicaion entitled "ANTENNA FEED" Ser. No. 499,396 is co-filed with this application and is incorporated herein by reference.

In the guided electro-magnetic wave art it is often desirable to add wave energy in a higher order mode to a fundamental mode propagating wave. One such instance is the addition of $LSE_{12}$ mode energy to a $TE_{10}$ mode wave to improve the radiation pattern from an antenna feed. The addition of an appropriate amount of $LSE_{12}$ mode energy reduces the pattern side lobes and increases the E-plane beamwidth.

Higher order modes may be excited in a waveguide by abrupt changes in the cross-sectional dimensions of the waveguide. Unfortunately, this technique tends to excite many modes rather than the single additional mode that is normally desired ($LSE_{12}$). The excited modes which actually propagate depend on the configuration of the waveguide. The modes which do not propagate produce reactive effects which result in impedance mismatch and reflections. A waveguide mode converter is needed which can selectively excite a desired mode without exciting other undesired modes.

In accordance with one preferred embodiment of the present invention a selective mode converter employs a mode converter including a mode conversion region which has an effective dielectric constant (EDC) which is different from that in adjacent regions within the waveguide. This mode conversion region has a thickness parallel to the axis of propagation within the waveguide. The EDC/thickness profile of this region varies across the waveguide in a manner which is effective for producing a displacement of the plane front of an initially plane incident propagating wave. For reasonably small amounts of displacement this phase displacement is equivalent to the addition of a new wave component in phase quadrature with the incident wave having an amplitude profile across the waveguide which is proportional to the amplitude profile of the desired higher order mode across the waveguide. For a conversion region having a uniform dielectric constant, the thickness preferably varies across the waveguide as the profile of the desired higher order mode.

IN THE DRAWINGS

Figure 1:
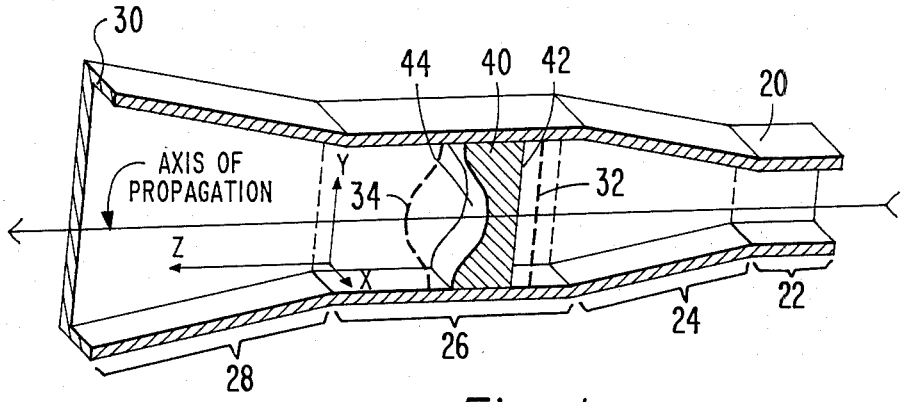
FIG. 1 illustrates a mode converter in accordance with the present invention operatively positioned within a waveguide for exciting an $LSE_{12}$ mode in a y-polarized incident plane wave.

In FIG. 1, a waveguide 20 containing a dielectric mode converter 40 in accordance with the present invention is illustrated. The waveguide 20 has a rectangular cross-section and comprises a series connection of four sections 22, 24, 26 and 28. Section 22 is a small constant-cross-section feed waveguide. Section 24 is a flared portion which expands from the small section 22 to section 26. Section 26 is a larger constant-cross-section waveguide which contains the mode converter 40. Section 28 is a second flared portion and connects the constant-cross-section portion 26 to a radiating aperture 30. An x-y-z rectangular co-ordinate system has its x and y axes parallel to adjacent waveguide walls and its z-axis parallel to the waveguide's axis of propagation.

Figure 2:
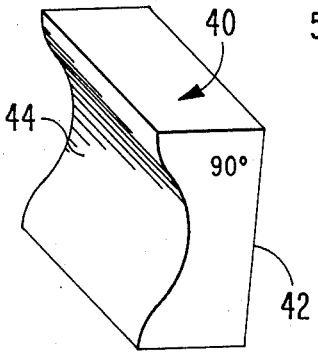
FIG. 2 shows the converter of FIG. 1 in greater detail.

The mode converter 40 which is illustrated in greater detail in FIG. 2 has a flat face 42 toward the feed waveguide 22 and a curved face 44 facing the radiating aperture 30. In the following description it is assumed that the dielectric material forming the mode exciter has a uniform dielectric constant. During transmission, a propagating wave having a planar phase front (illustrated by dashed section line 32) and its electric field parallel to the y-direction is incident on the right hand side of mode converter 40. In a rectangular waveguide this wave is propagated in the fundamental or $TE_{10}$ mode. This wave emerges at the left hand side of the mode converter 40 with a shaped wave front (illustrated by dashed section line 34). The displacement of the wave front from its initial planar form is proportional to the variation of the thickness of the dielectric mode converter 40 across the waveguide. The amplitude of this displacement is proportional to the variation in the thickness of the mode converter and thus for the illustrated mode converter is proportional to the amplitude in the z-direction of the curve defining the face 44 of the dielectric body. Thus, the phase displacement varies across the waveguide.

Figure 3:
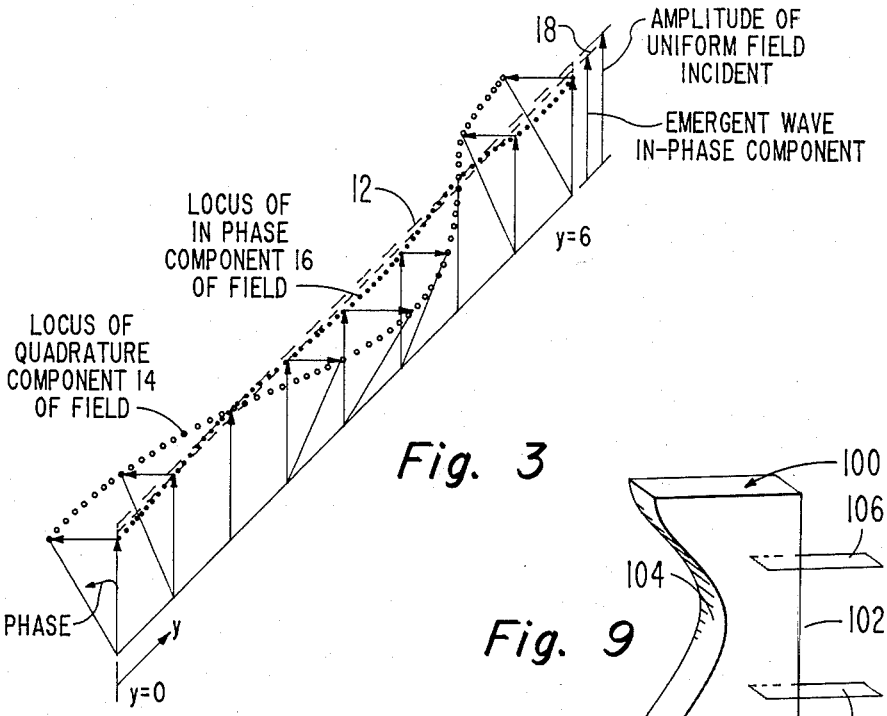
FIG. 3 illustrates the effect of the mode converter.

To a first order, this phase displacement varies directly as the variation in thickness of the mode converter at that location. The resultant field may be considered to be a main wave and a new wave in phase quadrature with the main wave. This is illustrated in diagram form in FIG. 3 where the field variation with y is illustrated. The incident wave has a uniform phase and a uniform amplitude A illustrated by the dashed line 12. The emergent wave has a quadrature component which varies as a cosine with one full cycle across the waveguide ($LSE_{12}$) which is illustrated by the dotted line 14. The emergent wave has an in-phase component which has a "uniform" amplitude 18 about which its actual amplitude 16 varies as a cosine with two full cycles across the waveguide ($LSE_{14}$). Thus, in the waveguide of FIG. 1 this converter converts a portion of the energy in the fundamental $TE_{10}$ mode to the $LSE_{12}$ mode. For a cosinusoidal variation (with respect to y, the E-plane coordinate) of insertion phase (phase displacement) an input wave in the fundamental $TE_{10}$ mode will be converted to waves in $TE_{10}$ and $LSE_{1m}$ modes, where the m's are the even integers. In close parallelism to the well known case of phase modulation, the higher order modes (or sidebands) have amplitudes proportional to the Bessel functions $J_p(x)$ where $p=m/2$ for the mode converter (p=order of the sideband) and x=the amplitude of the phase displacement (modulation coefficient). Thus, it is simple and direct to determine the amplitude of phase displacement required to establish a desired ratio of the amplitudes of the $LSE_{12}$ and $TE_{10}$ modes in the output wave.

When designed to convert a uniform incident wave into an emergent wave having an $LSE_{12}$ to $TE_{10}$ voltage ratio of 0.62, this mode converter does so with 99.7% of the energy in the desired modes and only 0.3% of the energy in other than those modes. This 0.3% of the energy which is in other modes is primarily in the $LSE_{14}$ mode (approximately −21 dB with respect to the maximum field of the $TE_{10}$ emergent wave) and to a lesser extent in the $LSE_{16}$ mode (approximately −41 dB with respect to the maximum field of the $TE_{10}$ emergent wave).

If the mode exciter 40 were of uniform thickness, the phase displacement would be uniform across the entire waveguide and the result would simply be a uniform delay in the incident wave with no conversion of energy to a higher order mode.

At the left hand edge of the mode converter 40 the $LSE_{12}$ mode at the center of the guide leads the $TE_{10}$ mode by 90°. Since the mode has a higher phase velocity than the $TE_{10}$ mode, the lead of $LSE_{12}$ wave increases as the two waves propagate to the left. For a feed horn, it is desired to have the fields of the $LSE_{12}$ and the $TE_{10}$ waves in-phase at the radiating aperture 30. Mode converter 40 is positioned in the rectangular cross section segment 26 of waveguide 20 in a manner which allows it to be slid toward and away from the radiating aperture 30. In this way, the relative phase of the $LSE_{12}$ and the $TE_{10}$ modes at the aperture 30 may be fine tuned to be precisely in the desired phase. For an in-phase relationship at aperture 30, the exciter should be a distance from aperture 30 which results in an additional 270° differential phase lead of the $LSE_{12}$ mode with respect to the $TE_{10}$ mode.

The relations described for the transmit case to produce a combination of $TE_{10}$ and $LSE_{12}$ fields of desired relative amplitude and phase at the mouth of a horn are, by the theory of reciprocity, true for the receive case. As a result, the directional patterns of the horn in transmit and receive modes are identical and the antenna's reception characteristics are the same as its transmission characteristics.

Alternative mode converter configurations are illustrated in FIGS. 4–9. In each of these converters the amplitude of the sine wave(s) which defines a surface(s) thereof has the same maximum amplitude as the converter 40 shown in FIG. 2.

Figure 4:
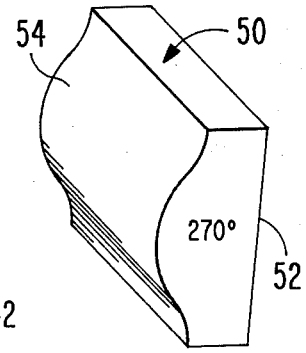
FIGS. 4–6 illustrate alternative configurations for the dielectric mode exciter of FIG. 2.

In FIG. 4 an alternative configuration 50 for the mode converter is illustrated which is thickest at the center of the waveguide and produces a 270° phase lead of the $LSE_{12}$ mode relative to the $TE_{10}$ mode as the wave emerges from the mode converter. The $LSE_{12}$ mode produced by this converter is the same as that produced by converter 40, except for the 180° difference in initial phase relative to the main wave. The need for only 90 degrees of differential phase lead of the $LSE_{12}$ mode with respect to the $TE_{10}$ mode to produce a desired in-phase relationship enables the converter 50 of FIG. 4 to be used successfully over a broader operating bandwidth than is true of those converters needing 270° of differential phase.

Figure 5:
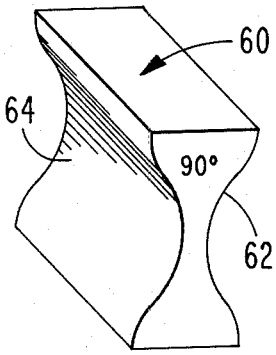

In FIG. 5, a further alternative configuration 60 for the mode converter is illustrated which once again produces a 90° phase lag. However, the amplitude of the $LSE_{12}$ mode is twice as great as that produced by the mode converter 40 because of the greater difference between the maximum and minimum thicknesses of the mode converter.

Figure 6:
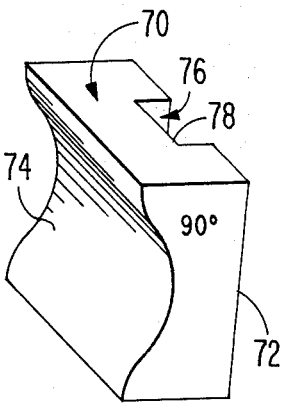

In FIG. 6 a further mode converter configuration 70 is illustrated in which a rectangular portion 76 is missing from the vicinity of the right hand face 72 of dielectric block 70. This mode converter is otherwise similar to the mode converter 40. This missing portion 76 of the block extends into the mode converter $\frac{1}{4}$ wavelength at a desired operating frequency. This has the effect of reducing the mismatch created in the waveguide by the transition between the air dielectric and the dielectric of the block. The rectangular cutout 76 is sized to provide a surface 78 at the back of the cutout which intercepts approximately one-half of the power-density-area integral of the $TE_{10}$ mode. This reduces the magnitude of the reflection coefficient without affecting the mode conversion efficiency of this mode converter.

Mode converters in accordance with this invention are in general wide bandwidth devices because they produce only a small discontinuity in the waveguide and thus reflect little energy. The high degree of direct coupling from the fundamental mode to the desired higher order mode produces a relatively small frequency dependency. Further, the ability to select a 90° or 270° initial lag allows the use of a relatively short waveguide between the converter and the aperture 30, consistent with other requirements such as aperture size and flare angle.

Figure 7:
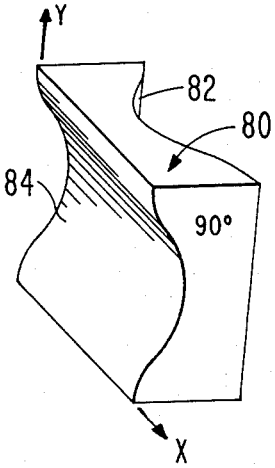
FIG. 7 illustrates a mode converter which is effective for producing $LSE_{12}$ modes in both x and y polarized waves.

In FIG. 7, a mode converter 80 is illustrated which has curved surfaces on both its front surface 84 and its back surface 82. Unlike the mode exciter 60, the orientation of these curves is rotated 90° relative to each other. As a result, this mode converter will generate an $LSE_{12}$ mode for a x-polarized incident wave as well as for a y-polarized incident wave. However, the relative phase of the $LSE_{12}$ modes with respect to their $TE_{10}$ modes in the different polarizations will be different because of the displacement of surface 82 from surface 84. This difference in relative phase may be desirable in rectangular, non-square cross-section guides in which the propagation velocities of different polarizations are different.

Figure 8:
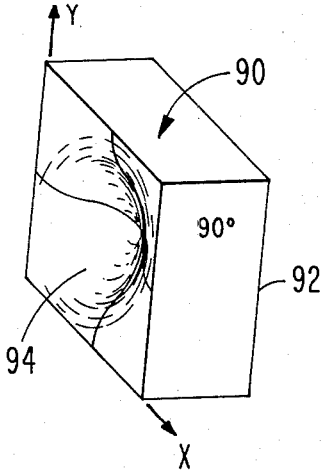
FIG. 8 illustrates an alternative configuration for exciting $LSE_{12}$ modes for both polarizations.

In FIG. 8, an alternative configuration 90 for a mode converter for x and y directed polarizations is illustrated in which the right hand face 92 is flat and the left hand face 94 is a surface of revolution. If desired, both faces could be surfaces of revolution. The defining locus of face 94 is a cosine wave. This eliminates the difference in relative phase for the $LSE_{12}$ modes in the two polarizations because they are generated at the same surface. This converter is useful in applications using circular polarization as x and y directed polarization waves are acted upon identically.

Figure 9:
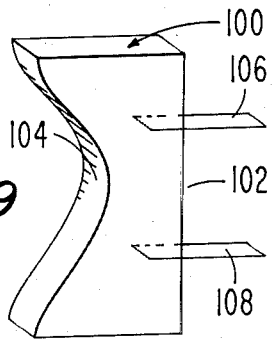
FIG. 9 illustrates a mode converter with absorption plates for absorbing undesired modes.

In FIG. 9, a mode converter 100, similar to mode converter 40, is illustrated which has two resistive plates 106 and 108 added to it. These plates are positioned at locations of $\frac{1}{4}$ and $\frac{3}{4}$ of the waveguide height. These resistive plates are effective for absorbing most of the energy in any undesired backward propagating waves in the $LSE_{12}$ mode which may emerge from the mode converter 100 in the rightward propagating direction as a result of reflections or waves incident from the left which are not in proper relation as to phase and amplitude to be converted to a pure fundamental $TE_{10}$ mode.

Figure 10:
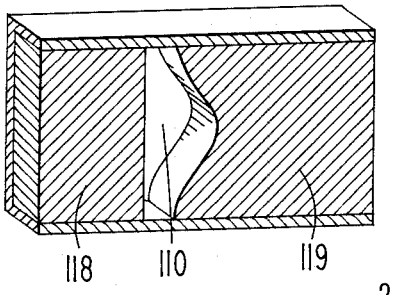
FIG. 10 illustrates a mode converter in accordance with the invention in a filled waveguide.

In FIG. 10, the mode conversion region 110 in the waveguide contains an air dielectric whereas the remainder of the adjacent portions of the waveguide is filled with solid dielectric portions 118 and 119 which have a higher dielectric constant. The mode converter of this invention is effective whether its dielectric constant is greater than or less than that of the remainder of the dielectric in the waveguide.

Where both the fundamental mode ($TE_{10}$) and the higher order mode ($LSE_{12}$) to which conversion is desired have the same H-plane distribution (a half cycle) the mode converter does not need to extend all the way across the waveguide in the H-plane direction. However, the maximum conversion coefficient for a given converter profile results when it extends all the way across the waveguide.

Figure 11:
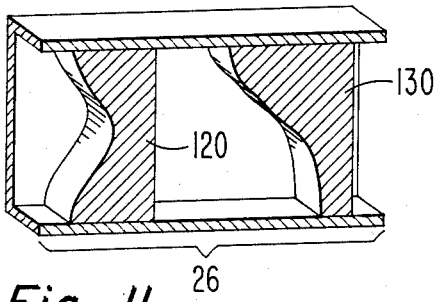
FIG. 11 illustrates a configuration for generating two higher order modes.

In FIG. 11, two mode converters 120 and 130 are illustrated positioned in sequence in the waveguide. The mode converter 120 is like converter 40 and generates an $LSE_{12}$ mode. Mode converter 130 has a half cosine wave configuration for its left hand face 134 and generates an $LSE_{11}$ mode. These two mode converters may be independently slid within waveguide segment 26 in order to bring their higher order modes into a desired relative phase at the radiating aperture 30.

Figure 12:
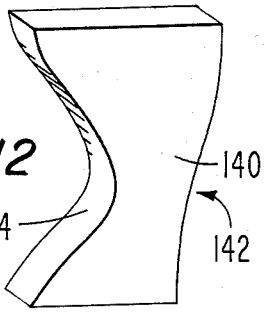
FIGS. 12 and 13 illustrate alternative configurations for generating two higher order modes.

In FIG. 12, a single multi-mode converter 140 is illustrated which generates both the $LSE_{12}$ mode and the $LSE_{11}$ mode. The $LSE_{11}$ mode is generated as the result of the half cosine wave configuration of the right hand face 142 of the mode converter. The $LSE_{12}$ mode is generated as the result of the full sine wave configuration of the left hand face 144 of the mode converter. Thus, this converter is equivalent to the combined converters 120 and 130, except for the inability to adjust the relative spacing between the faces.

Figure 13:
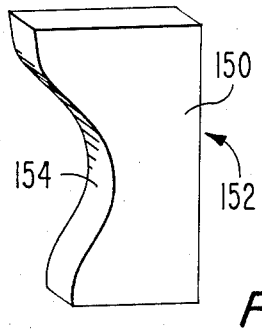

In FIG. 13, a mode converter 150 is illustrated which also generates the $LSE_{11}$ and the $LSE_{12}$ modes. However, in this mode converter the right hand face 152 is planar. The left hand face 154 is a sum of a full sine wave and a half cosine wave (the $LSE_{12}$ wave and the $LSE_{11}$ wave respectively). The result is a thickness profile for the mode converter which is effective for producing a combination of the $LSE_{12}$ and the $LSE_{11}$ modes. The relative amplitude of these two modes can be controlled by the shape of the face 154. If the face is the sum of equal amplitude sine and cosine waves, then the $LSE_{12}$ and the $LSE_{11}$ modes will be generated in equal amplitudes. If the curves are unequal in amplitude, then the generated waves will be unequal in amplitude.

For generating two or more modes, the use of a separate mode converter for each is preferred where it is desired to be able to adjust the relative phases of the modes. This is because the converters can be individually positioned within the waveguide in a manner to cause the modes to have a desired relative phase at a particular location in the waveguide.

The above illustrations and discussion have been in terms of generating the modes using a dielectric mode converter having a uniform dielectric constant. If desired, the effective dielectric constant (EDC) rather than the thickness of the mode converter may be profiled to produce the needed phase displacement to generate the desired modes. In the alternative, a combination of a variable effective dielectric constant (EDC) and a variable thickness may be employed. The controlling factor is the integral of the EDC over the thickness of the mode conversion region with each integral being taken along a path parallel to the axis of propagation.

Figure 14:
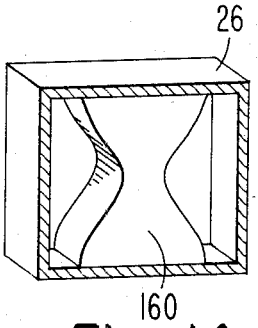
FIG. 14 illustrates a further alternative configuration for a mode converter in accordance with the present invention.

In FIG. 14, a mode converter 160 is illustrated which is shaped laterally of the waveguide rather than longitudinally of the waveguide. This mode converter is effective for generating the $LSE_{12}$ mode. However, this mode converter can cause bending of the E-field which can be undesirable. Therefore, for most situations, the mode converters of FIGS. 2 and 4–13 are preferred over the mode converter of FIG. 14.

The mode conversion technique of this invention is widely applicable. It is applicable to rectangular waveguides, circular waveguides and waveguides of a more general shape. The examples provided show the mode converter placed in an untapered portion of the waveguide. The technique, however, is applicable to non-uniform waveguides as well. A waveguide with a linear change of cross-sectional dimensions with respect to axial distance, for example, is often encountered in electromagnetic horns. When the amount of linear change is not great, the propagating modes approximate those in a uniform guide and the design and application of the mode converter remains unchanged. The dielectric material need not be a natural dielectric dependent upon molecular polarization for its properties. It may be an artificial dielectric such as those employed in artificial delay lenses. See for example, "Metallic Delay Lenses", by W. E. Kock, *Bell Systems Technical Journal,* Vol. 27 January 1948, pp. 58–82.

What is claimed is:

1. A waveguide mode converter for performing mode conversion between an incident wave and an emergent wave, each of said waves being propagated in at least a first mode and at least one of said waves propagating in at least one additional mode which is a higher order mode than said first mode, said mode converter comprising:

a waveguide having an axis of propagation; and a mode conversion body disposed within said waveguide, said mode conversion body having a different effective dielectric constant (EDC) than adjacent regions within said waveguide, said mode conversion body having a thickness parallel to said axis of propagation and an EDC/thickness profile which varies across said waveguide in a manner which is effective for producing a phase displacement in said incident propagating wave which is in phase quadrature with said incident wave and has an amplitude profile across said waveguide which is proportional to the amplitude profile across said waveguide of said at least one additional propagating mode.

2. The mode converter recited in claim 1 wherein:

said mode conversion body is moveably disposed in said waveguide for translation parallel to said axis of propagation.

3. The mode converter recited in claim 1 wherein:

said mode conversion body comprises a body of solid dielectric; and the dielectric in said adjacent regions within said waveguide is non-solid.

4. A waveguide mode converter for performing mode conversion between an incident wave and an emergent wave, each of said waves being propagated in at least a first mode and at least one of said waves propagating in at least one additional mode which is a higher order mode than said first mode, said mode converter comprising:

a waveguide having an axis of propagation; and a mode conversion body disposed within said waveguide, said mode conversion body having a different effective dielectric constant (EDC) than adjacent regions within said waveguide, said mode conversion body having a thickness parallel to said axis of propagation and an EDC/thickness profile which varies across said waveguide in substantially the same manner in which the amplitude profile of said at least one additional mode varies across said waveguide.

5. The mode converter recited in claim 4 wherein:

said body has a uniform dielectric constant and said body has a thickness profile across said waveguide which varies in the same manner as the amplitude profile of said at least one additional propagating mode varies.

6. The mode converter recited in claim 4 wherein:

said mode converter is designed to generate two or more higher order modes; and said EDC/thickness profile varies across said waveguide as the variation in the sum of the amplitude profiles of said two or more higher order modes.

7. A mode converter for selectively generating at least one selected higher order mode from a propagating wave, said converter comprising:

a body of dielectric material for disposition in a waveguide in the propagation path of said propagating wave, said body having a thickness in the direction of propagation and an effective dielectric constant which is different than that of adjacent regions within a waveguide;

said body of dielectric having a thickness/dielectric constant profile which is effective for producing a phase displacement of said propagating wave, said displacement having a profile which is proportional to the amplitude profile of said at least one selected higher order mode across the waveguide.

8. A mode converter for selectively generating at least one selected higher order mode from a propagating wave, said converter comprising:

a body of dielectric material for disposition in a waveguide in the propagation path of said propagating wave, said body having a thickness in the direction of propagation and an effective dielectric constant which is different than that of adjacent regions within a waveguide;

said body of dielectric having a thickness/dielectric constant profile which is effective for producing a phase displacement of said propagating wave, said displacement having a profile which is proportional to the amplitude profile of said at least one selected higher order mode across the waveguide; and said body having a uniform dielectric constant and a thickness profile across said waveguide which varies in the same manner in which the amplitude profile of said at least one higher order mode varies.

* * * * *